US006047419A

United States Patent [19]

Ferguson

[11] Patent Number: 6,047,419

[45] Date of Patent: Apr. 11, 2000

[54] MATERNAL POSITIONING SUPPORT SYSTEM

[76] Inventor: Patricia A. Ferguson, 7235 Ten Hill Rd., W. Bloomfield, Mich. 48322

[21] Appl. No.: 09/283,881

[22] Filed: Apr. 1, 1999

[51] Int. Cl.[7] ..... A47C 20/00

[52] U.S. Cl. ..... 5/630; 5/631; 5/632; 5/640

[58] Field of Search ..... 5/630, 631, 632, 5/633, 636, 637, 639, 640

[56] References Cited

U.S. PATENT DOCUMENTS

| | | | |
|---|---|---|---|
| 2,562,725 | 7/1951 | Leto et al. | 5/338 |
| 4,214,326 | 7/1980 | Spann | 5/632 |
| 4,233,700 | 11/1980 | Spann | 5/632 |
| 4,506,396 | 3/1985 | Ritchie, Jr. et al. | 5/431 |
| 4,788,728 | 12/1988 | Lake | 5/636 |
| 4,984,315 | 1/1991 | Ortman et al. | 5/431 |
| 5,088,141 | 2/1992 | Meyer et al. | 5/636 X |
| 5,097,551 | 3/1992 | Smith | 5/632 X |
| 5,182,828 | 2/1993 | Alivizatos | 5/631 |
| 5,279,310 | 1/1994 | Hsien | 5/632 |
| 5,647,076 | 7/1997 | Gearhart | 5/631 |
| 5,664,271 | 9/1997 | Bellavance | 5/632 |
| 5,978,990 | 11/1999 | Akey | 5/632 |
| 6,269,323 | 12/1993 | Krouskop | 5/632 |

*Primary Examiner*—Michael F. Trettel
*Attorney, Agent, or Firm*—Joseph N. Breaux

[57] ABSTRACT

A support system that is used to provide support to a pregnant patient positioned in the lateral recumbent position. The support system includes a wedge shaped main body portion for elevating one side of a patients body while lying thereon and a contoured, inclined pillow section having a spaced curved neck and head support portions defining an ear positioning trough therebetween.

1 Claim, 1 Drawing Sheet

MATERNAL POSITIONING SUPPORT SYSTEM

TECHNICAL FIELD

The present invention relates to pregnancy aids and more particularly to a maternal positioning support system that is used for providing support to a pregnant patient positioned in the lateral recumbent position; the maternal position support system including a wedge shaped main body portion for elevating one side of a patients body while lying thereon and a contoured, inclined pillow section having a spaced curved neck and head support portions defining an ear positioning trough therebetween; the main body portion having a triangular shaped pillow section attachment surface with hook and pile fasteners provided thereon; the pillow section having a triangular planar main body attachment side end surface provided with companionate hook and pile fasteners thereon that is equally dimensioned with the triangular pillow section attachment surface of the main body portion; the pillow section being detachably securable to the wedge shaped main body portion with the hook and pile fasteners; the pillow section including a curved, inclined neck support portion, a curved, inclined head support portion, and an ear positioning trough formed between the neck support portion and the head support portion; the neck support portion being positioned adjacent to and above the triangular planar main body attachment side end surface; the main body portion and the pillow section being of molded open cell foam construction to allow airflow therethrough during use.

BACKGROUND ART

The lateral recumbent position is often beneficial to a pregnant patient while she is sleeping, obtaining bed rest, in labor, or undergoing testing procedures (i.e. ultra sound etc.). In this position, the patient is reclined horizontally on the left side. This position is best for maximizing cardiac output and uterine blood flow and, in addition, the position helps maintain optimal maternal blood pressure; optimal placental perfusion and subsequently fetal oxigenation and well being. It would be a benefit, therefore, to have a support system to provide support and help maintain the patient in the lateral recumbent position. In addition, because patients are different in size, it would be a further benefit to have such a support system that included a main body support cushion for supporting the patients upper torso and a pillow section that was detachably securable to the main body portion that could be adjusted in position with respect to the main body portion to provide the proper support for the cervical spine and head.

GENERAL SUMMARY DISCUSSION OF INVENTION

It is thus an object of the invention to provide a maternal positioning support system that includes a main body support cushion for supporting the patients upper torso and a pillow section that is detachably securable to the main body portion.

It is a further object of the invention to provide a maternal positioning support system that includes a wedge shaped main body portion for elevating one side of a patients body while lying thereon and a contoured, inclined pillow section having a spaced curved neck and head support portions defining an ear positioning trough therebetween; the main body portion having a triangular shaped pillow section attachment surface with hook and pile fasteners provided thereon; the pillow section having a triangular planar main body attachment side end surface provided with companionate hook and pile fasteners thereon that is equally dimensioned with the triangular pillow section attachment surface of the main body portion; the pillow section being detachably securable to the wedge shaped main body portion with the hook and pile fasteners; the pillow section including a curved, inclined neck support portion, a curved, inclined head support portion, and an ear positioning trough formed between the neck support portion and the head support portion; the neck support portion being positioned adjacent to and above the triangular planar main body attachment side end surface; the main body portion and the pillow section being of molded open cell foam construction to allow airflow therethrough during use.

Accordingly, a maternal positioning support system is provided. The maternal positioning support system includes a wedge shaped main body portion for elevating one side of a patients body while lying thereon and a contoured, inclined pillow section having a spaced curved neck and head support portions defining an ear positioning trough therebetween; the main body portion having a triangular shaped pillow section attachment surface with hook and pile fasteners provided thereon; the pillow section having a triangular planar main body attachment side end surface provided with companionate hook and pile fasteners thereon that is equally dimensioned with the triangular pillow section attachment surface of the main body portion; the pillow section being detachably securable to the wedge shaped main body portion with the hook and pile fasteners; the pillow section including a curved, inclined neck support portion, a curved, inclined head support portion, and an ear positioning trough formed between the neck support portion and the head support portion; the neck support portion being positioned adjacent to and above the triangular planar main body attachment side end surface; the main body portion and the pillow section being of molded open cell foam construction to allow airflow therethrough during use.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
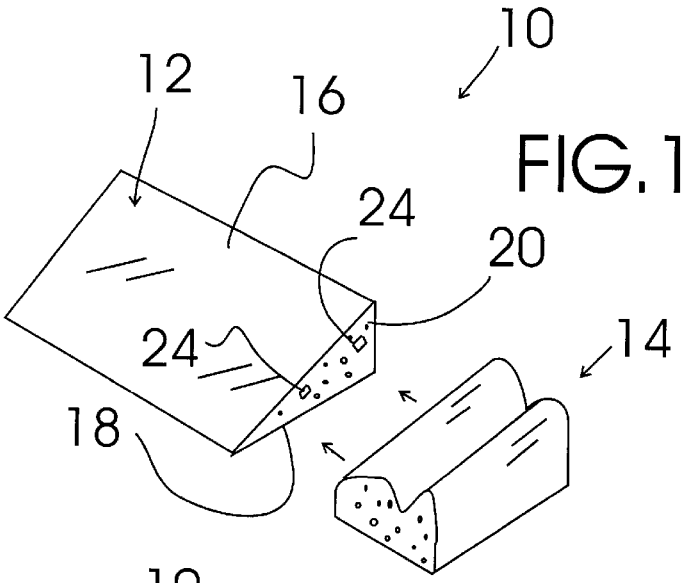
FIG. 1 is an exploded perspective view of an exemplary embodiment of the maternal position support system of the present invention that is used for providing support to a pregnant patient positioned in the lateral recumbent position; the maternal position support system including a wedge shaped main body portion for elevating one side of a patients body while lying thereon and a contoured, inclined pillow section having a spaced curved neck and head support portions defining an ear positioning trough therebetween; the main body portion having a triangular shaped pillow section attachment surface with hook and pile fasteners provided thereon; the pillow section having a triangular planar main body attachment side end surface provided with companionate hook and pile fasteners thereon that is equally dimensioned with the triangular pillow section attachment surface of the main body portion; the pillow section being detachably securable to the wedge shaped main body portion with the hook and pile fasteners; the pillow section including a curved, inclined neck support portion, a curved, inclined head support portion, and an ear positioning trough formed between the neck support portion and the head support portion; the neck support portion being positioned adjacent to and above the triangular planar main body attachment side end surface; the main body portion and the pillow section being of molded open cell foam construction to allow airflow therethrough during use.

FIG. 1 shows an exemplary embodiment of the maternal position support system of the present invention generally designated 10. Maternal position support system 10 includes a molded, open celled visco-elastic foam, wedge shaped main body portion, generally designated 12, for elevating one side of a patients body while lying thereon and a molded, open celled visco-elastic foam, contoured, inclined pillow section, generally designated 14. In this embodiment, main body portion 12 has an angled body contact surface 16 that is oriented at a thirty degree angle with respect a planar bottom surface 18 that is typically supported on the bed surface and a triangular shaped pillow section attachment surface 20 having two large box shaped hook and pile fastener section 24 provided thereon.

Figure 2:
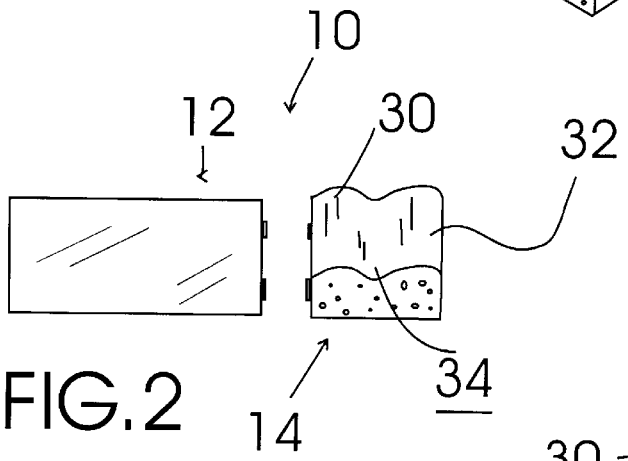
FIG. 2 is an exploded front plan view of the maternal position support system of the present invention showing the wedge shaped main body portion and the contoured, inclined pillow section including the curved inclined neck support portion, the ear positioning trough, and the curved inclined head support portion.
Figure 3:
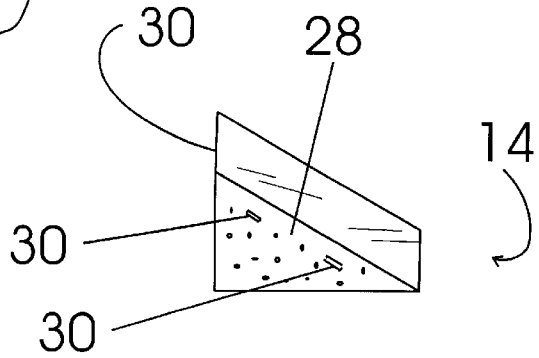
FIG. 3 is a side plan view of the contoured, inclined pillow section showing the neck support portion positioned above the main body portion attachment fasteners provided on the triangular planar main body attachment side end surface.

Referring now to FIG. 3, pillow section 14 has a triangular planar main body attachment side end surface 28 that is provided with companionate hook and pile fastener section 30 so that, referring now to FIG. 2, pillow section 14 is securable to main body portion 12 in a variety of positions to allow the user to configure the support system 10 to her particular body size and shape.

Pillow section 14 includes a curved, inclined neck support portion 30; a curved, inclined head support portion 32; and an ear positioning trough 34 formed between neck support portion 30 and head support portion 32. Referring back to FIG. 2, neck support portion 30 is positioned adjacent to and above triangular planar main body attachment side end surface 28.

It can be seen from the preceding description that a maternal positioning support system has been provided that includes a wedge shaped main body portion for elevating one side of a patients body while lying thereon and a contoured, inclined pillow section having a spaced curved neck and head support portions defining an ear positioning trough therebetween; the main body portion having a triangular shaped pillow section attachment surface with hook and pile fasteners provided thereon; the pillow section having a triangular planar main body attachment side end surface provided with companionate hook and pile fasteners thereon that is equally dimensioned with the triangular pillow section attachment surface of the main body portion; the pillow section being detachably securable to the wedge shaped main body portion with the hook and pile fasteners; the pillow section including a curved, inclined neck support portion, a curved, inclined head support portion, and an ear positioning trough formed between the neck support portion and the head support portion; the neck support portion being positioned adjacent to and above the triangular planar main body attachment side end surface; the main body portion and the pillow section being of molded open cell foam construction to allow airflow therethrough during use.

It is noted that the embodiment of the maternal positioning support system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A maternal positioning support system comprising:

a wedge shaped main body portion for elevating one side of a patients body while lying thereon and a contoured, inclined pillow section having a spaced curved neck and head support portions defining an ear positioning trough therebetween;

said main body portion having a triangular shaped pillow section attachment surface with hook and pile fasteners provided thereon;

said pillow section having a triangular planar main body attachment side end surface provided with companionate hook and pile fasteners thereon that is equally dimensioned with said triangular pillow section attachment surface of said main body portion;

said pillow section being detachably securable to said wedge shaped main body portion with said hook and pile fasteners;

said pillow section including a curved, inclined neck support portion, a curved, inclined head support portion, and an ear positioning trough formed between said neck support portion and said head support portion;

said neck support portion being positioned adjacent to and above said triangular planar main body attachment side end surface;

said main body portion and said pillow section being of molded open cell foam construction to allow airflow therethrough during use.

* * * * *